US010783861B2

(12) United States Patent
Fowler et al.

(10) Patent No.: US 10,783,861 B2
(45) Date of Patent: Sep. 22, 2020

(54) SYSTEM AND METHOD FOR COMPACT BASS CHAMBER WITH INTERNAL BEATER AND HI-HAT APPARATUS

(71) Applicants: Brandon Paul Fowler, Sedro Wolley, WA (US); Kim Michael Fowler, Sedro Woolley, WA (US)

(72) Inventors: Brandon Paul Fowler, Sedro Wolley, WA (US); Kim Michael Fowler, Sedro Woolley, WA (US)

( * ) Notice: Subject to any disclaimer, the term of this patent is extended or adjusted under 35 U.S.C. 154(b) by 0 days.

(21) Appl. No.: 16/424,955

(22) Filed: May 29, 2019

(65) Prior Publication Data

US 2019/0371285 A1 Dec. 5, 2019

Related U.S. Application Data

(60) Provisional application No. 62/678,109, filed on May 30, 2018.

(51) Int. Cl.

| | |
|---|---|
| ***G10D 13/11*** | (2020.01) |
| ***G10D 13/08*** | (2020.01) |
| ***G10D 13/02*** | (2020.01) |
| ***G10D 13/18*** | (2020.01) |
| ***G10D 13/10*** | (2020.01) |

(52) U.S. Cl.

CPC ..... *G10D 13/11* (2020.02); *G10D 13/02* (2013.01); *G10D 13/085* (2013.01); *G10D 13/18* (2020.02); *G10D 13/28* (2020.02)

(58) Field of Classification Search

CPC ..... G10D 13/11; G10D 13/02; G10D 13/18; G10D 13/28; G10D 13/065; G10D 13/00; G10D 15/00

See application file for complete search history.

(56) References Cited

U.S. PATENT DOCUMENTS

| | | | | |
|---|---|---|---|---|
| 9,449,588 | B2 | 9/2016 | Verderosa | |
| 10,013,960 | B1 * | 7/2018 | Wish | G10D 13/02 |
| 2008/0034944 | A1 * | 2/2008 | Aspland | G10D 13/02 84/415 |

* cited by examiner

*Primary Examiner* — Kimberly R Lockett
(74) *Attorney, Agent, or Firm* — FisherBroyles LLP; Kevin D. Jablonski

(57) ABSTRACT

A versatile cajón having a compact footprint that incorporates actuators for an internal bass-beater and an external hi-hat. The cajón may further serve as a base for supporting additional percussive instruments, such as snare drums, tom drums, cymbals, and Latin percussion. In an embodiment, a bass drum pedal may be secured inside the cajón and having a rotating shaft protruding through a side wall of the cajón. The shaft protrusion may be coupled to a foot pedal in an actuating manner. As such, when a percussionist presses down on the foot pedal (e.g., with a foot action), the shaft rotates the beater head to strike an internal wall of the cajón, thereby producing a bass-like percussive sound. Similarly, the system may include a hi-hat pedal and shaft combination that is also attached directly to one or more external side walls of the cajón.

17 Claims, 4 Drawing Sheets

SYSTEM AND METHOD FOR COMPACT BASS CHAMBER WITH INTERNAL BEATER AND HI-HAT APPARATUS

PRIORITY CLAIM

This application claims the benefit of U.S. Provisional Application No. 62/678,109, entitled "System and Method for Compact Bass Chamber with Internal Beater and Hi-Hat Apparatus" filed May 30, 2018, which is incorporated by reference in its entirety herein for all purposes.

BACKGROUND

Modern drum sets are exhibiting smaller and smaller profiles for percussionist that can occupy a small space on a stage or have a drum kit that is easily put away, transported and redeployed in various locations and venues. As a result, drum kits have trended toward a smaller overall profile to be highly portable and take up a small footprint of space. One persistent problem has been the space necessary for a proper bass drum sound, as the bass drum tends to be quite large in order to produce the low bass percussive sound.

In the past, a cajón, which is a small box-like resonant chamber, has been used by percussionists to produce a low-bass percussive sound by slapping or pounding on one external surface. Such an instrument may sometimes double as a seat for the percussionist as well, otherwise known as a throne. A problem with a manually sounded cajón is that producing the sound involves hand slap or pound, thereby occupying one or both of the percussionists' hands. Some solutions have included use of a bass-drum beater pedal that simulates the pound or slap of a percussionist's hand with a bass-drum beater actuated by a foot pedal. This allows the percussionist to produce the bass drum sound with a foot and allows both hands to be freed up for other uses (e.g., snare drum, hit-hat, cymbals) utilizing drum sticks. With space and compactness as a goal, a need has arisen for additional efficiency of space use in and around a drum kit using a cajón or other similar resonant-chamber percussive instruments.

BRIEF DESCRIPTION OF THE DRAWINGS

Embodiments of the subject matter disclosed herein in accordance with the present disclosure will be described with reference to the drawings, in which.

Note that the same numbers are used throughout the disclosure and figures to reference like components and features.

DETAILED DESCRIPTION

The subject matter of embodiments disclosed herein is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Embodiments will be described more fully hereinafter with reference to the accompanying drawings, which form a part hereof, and which show, by way of illustration, exemplary embodiments by which the systems and methods described herein may be practiced. This systems and methods may, however, be embodied in many different forms and should not be construed as limited to the embodiments set forth herein; rather, these embodiments are provided so that this disclosure will satisfy the statutory requirements and convey the scope of the subject matter to those skilled in the art.

By way of an overview, the systems and methods discussed herein may be directed to a versatile cajón having a compact footprint that incorporates actuators for an internal bass-beater and an external hi-hat. The cajón may further serve as a base for supporting additional percussive instruments, such as snare drums, tom drums, cymbals, and Latin percussion. In an embodiment, a bass drum pedal may be secured inside the cajón and having a rotating shaft protruding through a side wall of the cajón. The shaft protrusion may be coupled to a foot pedal in an actuating manner. As such, when a percussionist presses down on the foot pedal (e.g., with a foot action), the shaft rotates the beater head to strike an internal wall of the cajón, thereby producing a bass-like percussive sound. Similarly, the system may include a hi-hat pedal and shaft combination that is also attached directly to one or more external side walls of the cajón. These and other aspects are described in greater detail below with respect to FIGS. 1-4.

Figure 1:
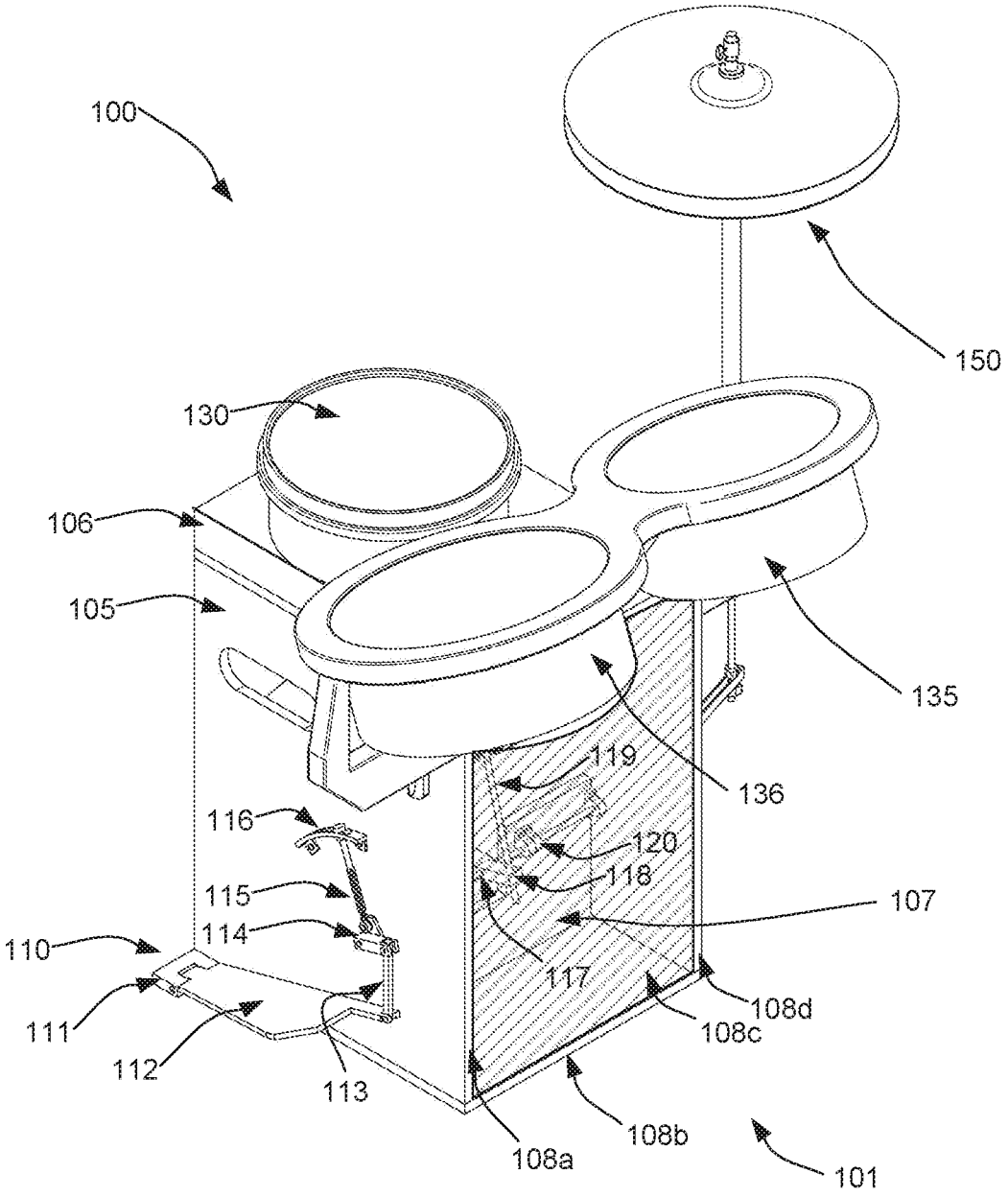
FIG. 1 is an isometric view of a compact drum kit utilizing a cajón according to an embodiment of the subject matter disclosed herein.

FIG. 1 is a diagram of a compact drum kit 100 utilizing a versatile cajón 101 according to an embodiment of the subject matter disclosed herein. A cajón (Spanish: [ka'xon]; "box", "crate" or "drawer") is a box-shaped percussion instrument originally from Peru, played by slapping the front or rear faces (generally thin plywood) with the hands, fingers, or sometimes various implements such as brushes, mallets, or sticks. Cajónes are primarily played in Afro-Peruvian music, as well as contemporary styles of flamenco and jazz among other genres. The term cajón is also applied to other box drums used in Latin American music such as the cajón de rumba used in Cuban rumba and the cajón de tapeo used in Mexican folk music.

In FIG. 1, the improved versatile cajón 101 is shown having attached foot pedals on either side of the cajón. A first foot pedal 110 is configured to actuate a bass drum beater 119 that is internally secured within the cajón 101. A second foot pedal (shown in FIG. 3 as element 310) may be used to actuate a hi-hat 150. Further, the cajón 101 may be used to support additional percussion, such as a snare drum 130, tom drums 135 and 136, and cymbals (not shown). As skilled artisan understands that the foot pedals 110 and 310 could be swapped from left to right depending on the preference of the percussionist. For example, a right-handed percussionist typically prefers the hi-hat pedal 310 on the left side and the bass pedal 110 on the right side, while a left-handed percussionist prefers the reciprocal. With the compact nature of the versatile cajón 101, cymbal stands (not shown) or other stands may be stationed close to the versatile cajón 101 for reducing overall footprint size of drum kit 100.

The cajón 101 typically comprises a bass chamber 105 that includes six walls that form an internal cavity 107. These walls may be substantially flat walls through other shapes and contours are possible. Further, the internal cavity may be formed by more or fewer than six walls. For brevity, six wall configurations are discussed herein. The six walls may typically comprise a top wall (obscured by other drums), a bottom wall 108*b*, a left wall 108*d*, a right wall 108*a*, a front wall (not visible in this perspective) and a beater wall 108*c* (shown as transparent hatched wall so as to reveal internal components). With this arrangement, the top wall is contiguous with the left wall 108*d*, the right wall 108*a*, the front wall and the beater wall 108*c*, but separate from the bottom wall 108*b* and the bottom wall 108*b* is contiguous with the left wall 108*d*, the right wall 108*a*, the front wall and the beater wall 108*c* but separate from the top wall.

Looking deeper into the aspect of the bass beater pedal 110, FIG. 1 shows the extra bass beater pedal 110 is attached to the right wall 108*a*. The bass beater pedal 110 may include a pedal base portion 111 that may be attached to the right wall 108*a* and flush with the bottom wall 108*b*. The pedal base portion 111 is rotatably attached to a main pedal portion 112 that is suited to engage a human foot. The main pedal portion 112 may be tapered outward such the that the main pedal portion 112 becomes wider the further way from the base pedal portion 111. The beater pedal assembly further includes an externally attached biasing member 115 (e.g., a spring) configured to bias the actuator pedal to a resting position after an actuation. The biasing member 115 may be coupled to the main pedal portion 112 through first and second beater pedal linkage members 113 and 114.

Turning attention to the internal cavity 107 of the bass chamber 105, additional components of the overall bass chamber beater assembly 110 are disposed. Specifically, the internal structure includes a beater shaft 117 that is configured to rotate in a first rotational direction when the bass beater pedal is actuated downward and to rotate back in an opposite rotational direction when the pedal is forced back upward by the biasing member 115. In order to facilitate the lateral motion of an attached beater 119, the beater 119 may be attached to the beater shaft 117 through a beater shaft linkage member 118. The fluid rotational motion of the beater shaft 117 may be further facilitated by beater shaft mounts 120 that hold the beater shaft 117 securely, yet rotatably affixed within a single axis. Further yet, aspects of the actuation motion may be adjusted by shifting the linkage point on an adjustment wheel 116 affixed to the exterior of the bass chamber 105 on the right-side wall.

The compact nature of the bass chamber 105 allows for a custom compact drum kit to be realized in conjunction with additional attachable and/or separate components. In one embodiment, the bass chamber will include stabilization spikes (not shown) that may be mounted to right and left walls and extendable at an angle toward the floor to assist with support the bass chamber to prevent overall movement when being played. Further, the bass chamber 105 may have a small footprint with dimensions that are considered small in the industry. In one embodiment, the dimensions of the bass chamber are 22" in width×18.5" in height×16" in depth with an overall weight of 16.9 pounds. The compact nature and lightweight design are improved by the use of custom machined parts are made from aircraft grade aluminum.

Additional percussive instrument may attach to top wall of the bass chamber 105 of the cajón 101. In this embodiment, one can see a snare drum 130 and two tom-tom drums 135 and 136 mounted to the top of the cajón 101. Further, an additional resonator chamber 106 may be attached to the top of the bass chamber 105 of the cajón 101 to provide added resonance for the bass and snare hits as well as height to place the snare 130 and toms 135 and 136 at useful positions. This second chamber 106 includes a second internal cavity wherein the second chamber 106 is smaller than the bass chamber 105 and may typically be contiguous with a top wall of the bass chamber 105. The additional resonator chamber 106 may include one or more resonance holes (not visible in FIG. 1) in one or more walls. Further, other percussion, such as cymbals, auxiliary percussion, and Latin percussion (e.g., cowbell, tambourine, claves, wood blocks,) may be attached as well (not shown in FIG. 1 for clarity). These may be attached by means of dedicated mounts that are affixed to an external wall of the bass chamber 105 (again, not shown for clarity). Further yet, the external walls of the bass chamber may include additional storage mounts for storing various components for transport and storage.

Figure 2:
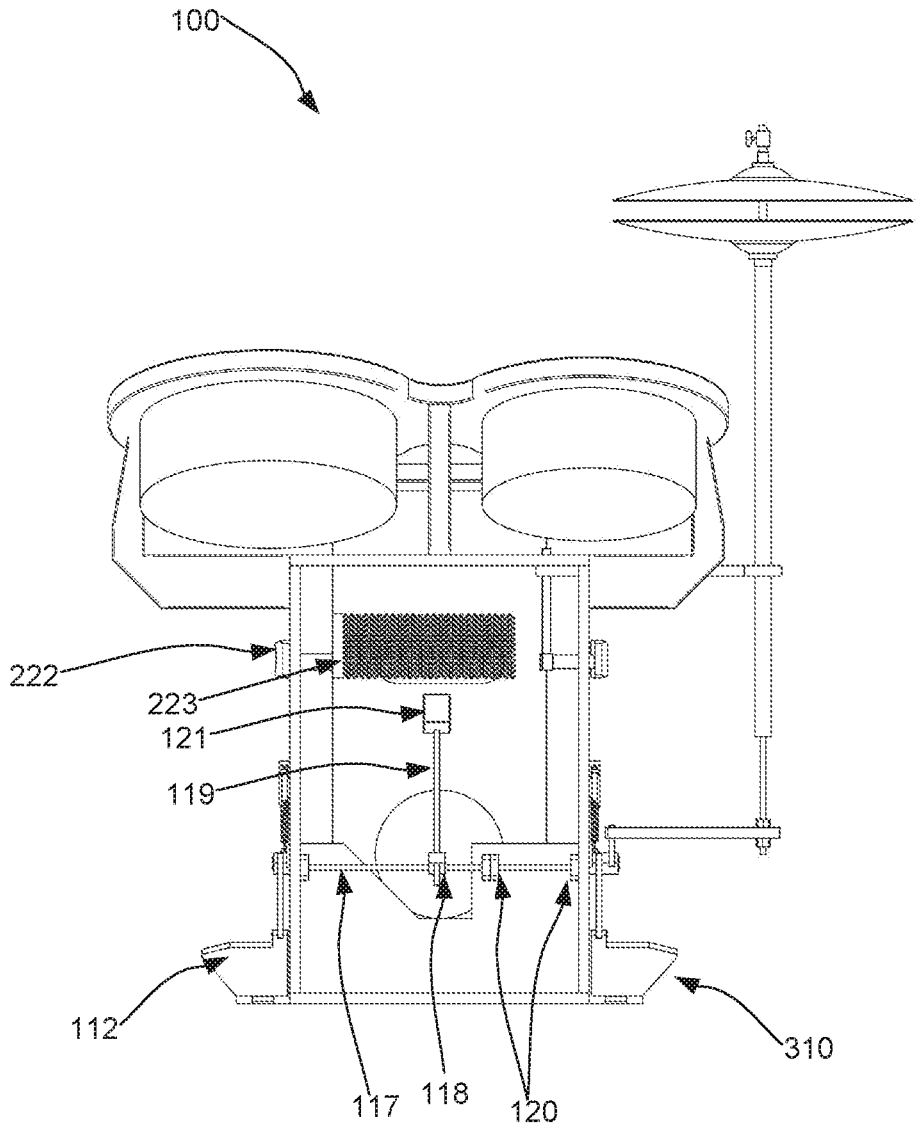
FIG. 2 is a rear view of the compact drum kit of FIG. 1 showing additional details inside the cajón according to an embodiment of the subject matter disclosed herein.

FIG. 2 is a front view of the compact drum kit of FIG. 1 showing additional details inside the cajón according to an embodiment of the subject matter disclosed herein. In this view, one can see directly inside the cajón 101 as the beater wall (108*c* of FIG. 1) is not shown. Typically, the cajón walls comprise sheets of 0.5 to 0.75 inches thick wood, (e.g., solid wood or plywood). In some embodiments, a thinner sheet of plywood is used as the side wall intended to be the striking surface or head on the beater wall 108*c*. The striking surface of the cajón drum is commonly referred to as the "tapa". In some embodiments, one or more resonance holes (shown in greater detail with respect to FIG. 4) are cut into one or more other walls (e.g., typically the side opposite the striking surface. The top edges can often be left unattached and can be slapped against the box (e.g., like closing a lid on a box). In further embodiments, the cajón may have supports or feet made of rubber or other resilient substance, and may include several adjustors (e.g., screws) at one or more sides for adjusting percussive timbre.

In the embodiment of FIG. 2, one can see the internal shaft 117 that protrudes out a side wall attaching to a bass beater pedal 110 that be actuated up and down to rotate the shaft 117. The rotating shaft 117 may be attached to an internal bass drum beater 119 that strikes the (missing) beater wall (e.g., the striking surface) when rotated. Generally speaking, the harder one pushes down on the pedal, the harder the bass drum beater 119 will strike the striking surface. The cajón may also include stretched cords or snares 223 pressed against the one or more walls for a buzz-like effect or tone. These effects may be adjusted through external actuators 222 attached to the stretched cords or snares. In other embodiments, guitar strings, rattles, or maracas may serve this purpose. Bells may also be installed inside near the snares 223.

In this embodiment, the bass drum beater pedal 110 that actuates the internal beater 119 is disposed on the right-hand side (player perspective) of the cajón (the view in FIG. 2 is from the rear). This is typical for right-handed players. In other embodiments, the bass drum beater pedal 110 that actuates the internal beater 119 is disposed on the left-hand side of the cajón which is typical for left-handed players. Further, the internal drum beater head 121 may be swapped in and out with different configurations and styles of beater heads. Still referring to FIG. 2, the embodiment shown includes a pedal on left-hand side for a hi-hat (again, this is a view from the rear side of the cajón). The hi-hat is external but attached to cajón to reduce the overall footprint of the drum kit. As before, this feature may be on right-side for left-handed players.

Figure 3:
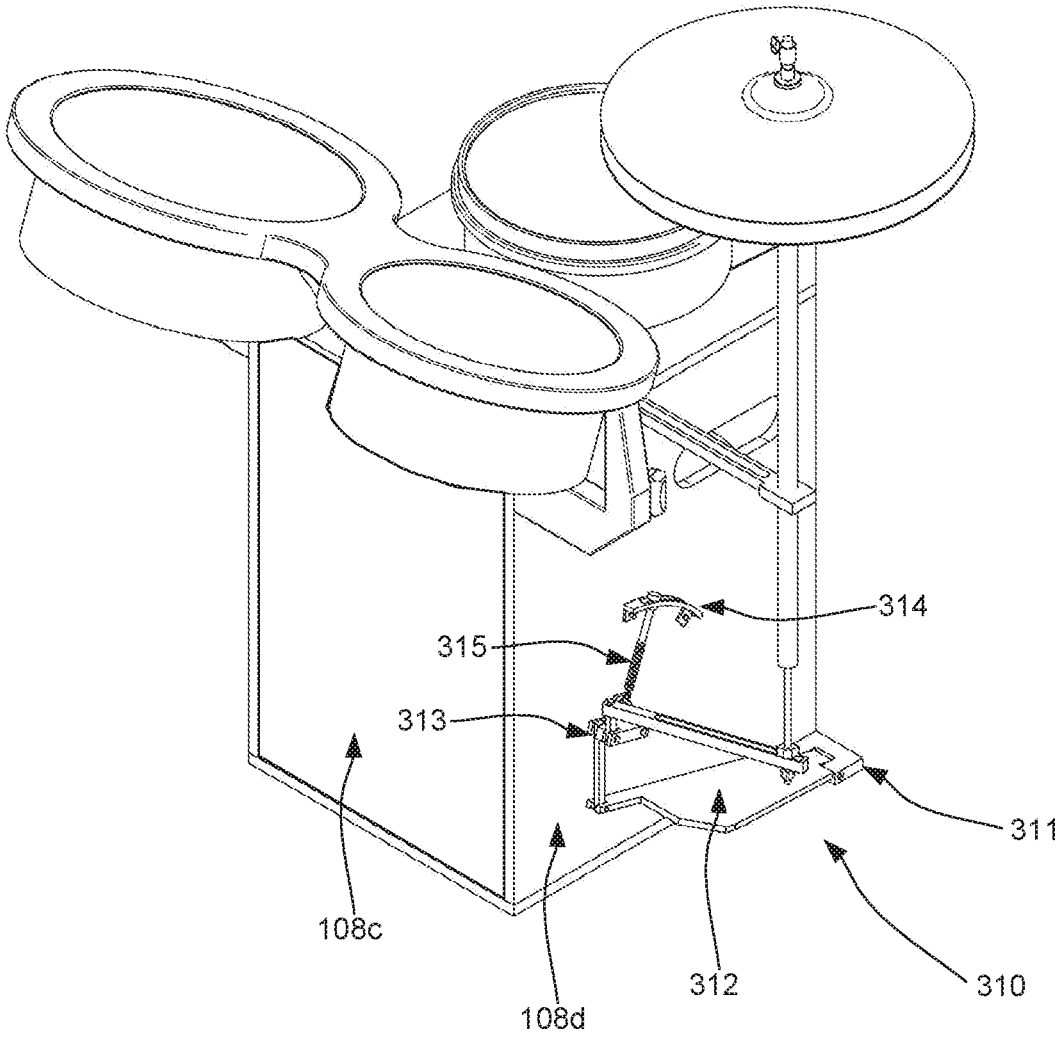
FIG. 3 is a second isometric diagram of the compact drum kit of FIG. 1 showing the hi-hat side in greater detail according to an embodiment of the subject matter disclosed herein.

FIG. 3 is a second isometric diagram of the compact drum kit 100 of FIG. 1 showing the hi-hat side in greater detail according to an embodiment of the subject matter disclosed herein. In this view, one can see that the beater wall 108*c* is affixed to the front of the bass chamber 105. In some embodiments, the beater wall 108*c* is removably fixed with fasteners (e.g., bolts, screws, rivets, and the like). In other embodiments, the beater wall 108*c* is more permanently attached via wood glue and interlocking protrusions (not shown). As such, the beater wall 108*c* is in place for the internal drum actuator (not seen in FIG. 3) to strike the beater wall 108*c* when the exterior beater pedal actuator 110 is actuated. The beater wall 108*c* may be different styles of beater wall including a tapa faceplate or bass drum batter head. The material may be word, mylar, leather or other suitable batter head or beater wall.

Looking deeper into the aspect of the hi-hat pedal 310, FIG. 3 shows the external hi-hat pedal 310 is attached to the left wall 108*d*. The hi-hat pedal 310 may include a pedal base portion 311 that may be attached to the left wall 108*d* and flush with the bottom wall 108*b*. The pedal base portion 311 is rotatably attached to a main pedal portion 312 that is suited to engage a human foot. The main pedal portion 312 may be tapered outward such the that the main pedal portion 312 becomes wider the further way from the base pedal portion 311. The hi-hat pedal 310 assembly further includes an externally attached biasing member 315 (e.g., a spring) configured to bias the actuator pedal 312 to a resting position after an actuation. The biasing member 315 may be coupled to the main pedal portion 312 through first and second beater pedal linkage members 313 and 314.

One can see that the biasing member 315 allows the pedal 312 to return to a first position after each hi-hat actuation to be ready for the next actuation. This mechanism allows the pedal 312 to pull two cymbals of a hi-hat together and then return to a first position after each clasp to be ready for the next actuation. Thus, the rotating shaft is actuated by pedal 312 by human foot action but then returned to the first position by the potential energy stored in the force transfer mechanism (typically another reciprocating spring 315). The pedal tension (e.g., the force of the spring) is adjustable as is the linkage to the pedal. Further, the pedal may be detachable at the left-wall 108*d* coupling for storage and transport.

Figure 4:
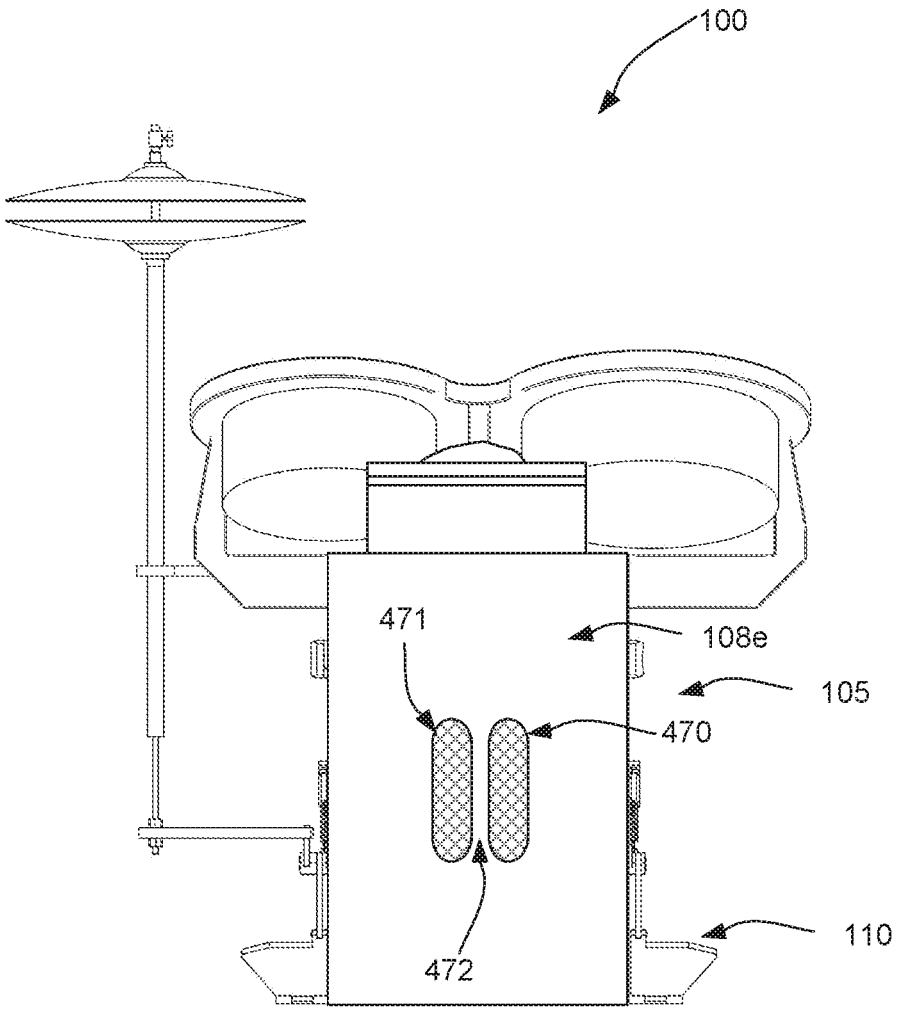
FIG. 4 is a front view of the compact drum kit of FIG. 1 showing a front wall covering installed having resonance ports according to an embodiment of the subject matter disclosed herein.

FIG. 4 is a front view of the compact drum kit of FIG. 1 showing a front wall 108*e* installed having resonance ports 470 and 471 according to an embodiment of the subject matter disclosed herein. In this view, the bass chamber front wall 108*e* further includes a pair of resonance ports 470 and 471. Resonance ports are used with percussive instruments to provide a means for air to be pushed out of the resonance chamber (e.g., the bass chamber 105) so that the internal reverberation or resonance can be more audibly heard outside of the percussive instruments. Some instruments may include smaller or larger resonance ports and more or fewer ports as shown here. Further, the shape and style of resonance ports may vary. In this embodiment, there are two oblong oval shaped ports that are disposed side-by-side on the beater wall 108*c*. This is disposed in a manner such that a first resonance port 470 cut through the beater wall 108*c* as is the second resonance port 471. The first and second resonance ports 470 and 471 are disposed adjacent to each other forming a narrow portion 472 of the first wall suited to be grasped by a human hand. That is, the two ports 470 and 471 form a handle so that one can carry the bass chamber like a suitcase.

All references, including publications, patent applications, and patents, cited herein are hereby incorporated by reference to the same extent as if each reference were individually and specifically indicated to be incorporated by reference and/or were set forth in its entirety herein.

The use of the terms "a" and "an" and "the" and similar referents in the specification and in the following claims are to be construed to cover both the singular and the plural, unless otherwise indicated herein or clearly contradicted by context. The terms "having," "including," "containing" and similar referents in the specification and in the following claims are to be construed as open-ended terms (e.g., meaning "including, but not limited to,") unless otherwise noted. Recitation of ranges of values herein are merely indented to serve as a shorthand method of referring individually to each separate value inclusively falling within the range, unless otherwise indicated herein, and each separate value is incorporated into the specification as if it were individually recited herein. All methods described herein can be performed in any suitable order unless otherwise indicated herein or clearly contradicted by context. The use of any and all examples, or exemplary language (e.g., "such as") provided herein, is intended merely to better illuminate embodiments and does not pose a limitation to the scope of the disclosure unless otherwise claimed. No language in the specification should be construed as indicating any non-claimed element as essential to each embodiment of the present disclosure.

Different arrangements of the components depicted in the drawings or described above, as well as components and steps not shown or described are possible. Similarly, some features and sub-combinations are useful and may be employed without reference to other features and sub-combinations. Embodiments have been described for illustrative and not restrictive purposes, and alternative embodiments will become apparent to readers of this patent. Accordingly, the present subject matter is not limited to the embodiments described above or depicted in the drawings, and various embodiments and modifications can be made without departing from the scope of the claims below.

That which is claimed is:

1. A percussive instrument, comprising:

a bass chamber having substantially flat walls forming an internal cavity;

an actuator pedal attached to the bass chamber external to the internal cavity;

a beater attached to the bass chamber internal to the internal chamber and configured to strike at least one wall among the substantially flat walls when the externally attached actuator pedal is actuated; and a second chamber having a second internal cavity, the second chamber smaller than the bass chamber, the second chamber disposed contiguous with a top wall of the bass chamber.

2. The percussive instrument of claim 1, wherein the substantially flat walls comprise a top wall, a bottom wall, a left wall, a right wall, a front wall and a beater wall, such that the top wall is contiguous with the left wall, the right wall, the front wall and the beater wall, but separate from the bottom wall and such that the bottom wall is contiguous with the left wall, the right wall, the front wall and the beater wall but separate from the top wall.

3. The percussive instrument of claim 2, wherein the actuator pedal is attached to the right wall and the beater is configured to strike the beater wall.

4. The percussive instrument of claim 1, further comprising an externally attached biasing member configured to bias the actuator pedal to a resting position after an actuation.

5. The percussive instrument of claim 1, further comprising at least one tom drum attached to a mount configured to attach to a top wall of the bass chamber.

6. The percussive instrument of claim 1, further comprising at least one cymbal mount attached to at least one wall of the bass chamber.

7. The percussive instrument of claim 1, further comprising:

a hi-hat storage mount disposed on an external wall of the bass chamber and configured to store a hi-hat cymbal; and a cymbal storage mount disposed on an external wall of the bass chamber and configured to store a cymbal mount.

8. A percussive instrument, comprising:

a bass chamber having substantially flat walls forming an internal cavity;

an actuator pedal attached to the bass chamber external to the internal cavity;

a beater attached to the bass chamber internal to the internal chamber and configured to strike at least one wall among the substantially flat walls when the externally attached actuator pedal is actuated;

percussive snares disposed inside the internal cavity and configured to enhance a sound produced by the beater striking the at least one wall; and a snare switch having an externally attached actuator for engaging or disengaging the percussive snares with at least one wall of the internal cavity.

9. A percussive instrument, comprising:

a bass chamber having substantially flat walls forming an internal cavity;

an actuator pedal attached to the bass chamber external to the internal cavity;

a beater attached to the bass chamber internal to the internal chamber and configured to strike at least one wall among the substantially flat walls when the externally attached actuator pedal is actuated; and a second actuator pedal attached to the bass chamber external to the internal cavity, the second actuator pedal configured to actuate a hi-hat cymbal.

10. A percussive instrument, comprising:

a bass chamber having substantially flat walls forming an internal cavity;

an actuator pedal attached to the bass chamber external to the internal cavity;

a beater attached to the bass chamber internal to the internal chamber and configured to strike at least one wall among the substantially flat walls when the externally attached actuator pedal is actuated; and a first resonance port disposed through a first wall of the bass chamber and a second resonance port disposed through the first wall wherein the first and second resonance ports are disposed adjacent to each other forming a narrow portion of the first wall suited to be grasped by a human hand.

11. A cajón, comprising:

a bass chamber having substantially flat walls forming an internal cavity;

an actuator pedal attached to the bass chamber external to the internal cavity; and a beater attached to the bass chamber internal to the internal chamber and configured to strike at least one wall among the substantially flat walls when the externally attached actuator pedal is actuated; and a second actuator pedal attached to the bass chamber external to the internal cavity, the second actuator pedal configured to actuate a hi-hat cymbal.

12. The cajón of claim 11, wherein the substantially flat walls comprise a top wall, a bottom wall, a left wall, a right wall, a front wall and a beater wall, such that the top wall is contiguous with the left wall, the right wall, the front wall and the beater wall, but separate from the bottom wall and such that the bottom wall is contiguous with the left wall, the right wall, the front wall and the beater wall but separate from the top wall;

wherein the front wall comprises an area that less than an area of the beater wall.

13. The cajón of claim 12, wherein the actuator pedal is attached to the right wall and the beater is configured to strike the beater wall.

14. The cajón of claim 11, further comprising:

percussive snares disposed inside the internal cavity and configured to enhance a sound produced by the beater striking the at least one wall; and a snare switch having an externally attached actuator for engaging or disengaging the percussive snares with at least one wall of the internal cavity.

15. The cajón of claim 11, further comprising a second chamber having a second internal cavity, the second chamber smaller than the bass chamber, the second chamber disposed contiguous with a top wall of the bass chamber.

16. The cajón of claim 11, further comprising a first resonance port disposed through a first wall of the bass chamber and a second resonance port disposed through the first wall wherein the first and second resonance ports are disposed adjacent to each other forming a narrow portion of the first wall suited to be grasped by a human hand.

17. A percussion system, comprising:

a bass chamber having a top wall, a bottom wall, a left wall, a right wall, a front wall, and a beater wall that collectively from a substantially rectangular internal cavity;

a first actuator pedal attached to the bass chamber external to the internal cavity;

a beater attached to the bass chamber internal to the internal chamber and configured to strike at least one wall among the substantially flat walls when the externally attached actuator pedal is actuated;

at least one tom drum attached to a mount configured to attach to a top wall of the bass chamber;

a second actuator pedal attached to the bass chamber external to the internal cavity, the second actuator pedal configured to actuate a hi-hat cymbal; and at least one cymbal mount attached to at least one wall of the bass chamber.

* * * * *